US007237739B2

(12) United States Patent
Kock

(10) Patent No.: US 7,237,739 B2
(45) Date of Patent: Jul. 3, 2007

(54) GRINDING MACHINE AND METHOD OF GRINDING MATERIAL

(75) Inventor: Bernhard Kock, Moers (DE)

(73) Assignee: Metso Lindemann GmbH (DE)

( * ) Notice: Subject to any disclaimer, the term of this patent is extended or adjusted under 35 U.S.C. 154(b) by 210 days.

(21) Appl. No.: 10/530,923

(22) PCT Filed: Oct. 9, 2003

(86) PCT No.: PCT/DE03/03375

§ 371 (c)(1),
(2), (4) Date: Apr. 8, 2005

(87) PCT Pub. No.: WO2004/035215

PCT Pub. Date: Apr. 29, 2004

(65) Prior Publication Data

US 2006/0065769 A1 Mar. 30, 2006

(30) Foreign Application Priority Data

Oct. 10, 2002 (DE) ..... 102 47 281

(51) Int. Cl.
*B02C 18/16* (2006.01)

(52) U.S. Cl. ..... 241/243

(58) Field of Classification Search ..... 241/243, 241/36, 295

See application file for complete search history.

(56) References Cited

U.S. PATENT DOCUMENTS 5,454,522 A 10/1995 Ballu
5,992,777 A * 11/1999 Aagaard ..... 241/236
2003/0230657 A1* 12/2003 Dorscht ..... 241/243

FOREIGN PATENT DOCUMENTS

| | | | |
|---|---|---|---|
| DK | 169378 | B1 | 10/1994 |
| EP | 0521081 | B1 | 9/1994 |
| EP | 0928222 | B1 | 6/2000 |
| EP | 1072314 | A1 | 1/2001 |
| JP | 2002045720 | | 2/2002 |

* cited by examiner

*Primary Examiner*—Mark Rosenbaum
(74) *Attorney, Agent, or Firm*—Polster, Lieder, Woodruff & Lucchesi, L.C.

(57) ABSTRACT

The invention relates to a grinding machine for all kinds of material, the machine comprising: a receiving element for the material (5); at least one shaft (2) positioned in the housing (1) and provided with grinding tools (3); rigid cutting tools (4) which are arranged in the housing (1) and against which the grinding tools (3) operate, grinding the material (5) with specifically low forces. To this end, the grinding tools (3) comprise cutting regions (3.1, 3.2) within which an inner cutting region (3.1) can take a large amount of material (5) to be ground and grind the same, thus comprising a small lever arm, and an outer cutting region (3.2) can take a smaller amount of material (5) to be ground and grind the same, thus comprising a large lever arm. According to the invention, the rigid cutting tools (4) are provided with teeth (4.2) having profiles (4.3) which cooperate with one of the cutting regions (3.1, 3.2), a first transversal edge (3.4) of the grinding tools (3) being oriented towards a second transversal edge (4.4) of a tooth (4.2) of the rigid cutting tools (4) in such a way that it cuts past the same.

17 Claims, 3 Drawing Sheets

3
3
1
1.2
3.2
3.1
3.3
2
4
4.2
5
2

4.4, 3.4
3
3
1
1.2
4.3
4.5, 4.6
2
4
5
2

4.4
3.4
3.4
1
1.2
4.1
5
4.1
4.2
2
4
2
4.3
4.2

GRINDING MACHINE AND METHOD OF GRINDING MATERIAL

CROSS-REFERENCE TO RELATED APPLICATION

This is the National Phase application of PCT/DE2003/003375 having an international filing date of 9 Oct. 2003 and which claims priority to German application no. DE10247281.3 filed 10 Oct. 2002, which are herein incorporated by reference.

BACKGROUND OF THE INVENTION

The invention relates to a grinding machine and method of grinding for all kinds of material, for example waste, such as domestic waste and bulky waste, or wood. The machines comprises a receiving element for the material, provided in a housing, at least one driven shaft, on which grinding tools are provided, and rigid cutting tools arranged in the housing as opposing tools for the grinding tools for grinding the material.

PRIOR ART

Comminution or grinding machines of this type have been disclosed under the designation "Zerreiβer".

Current grinders such as those disclosed by EP 0 521 081 B1, use the comminution tools that are formed by U-shaped knives, which are located in a plane at right angles to the axis of rotation for the shafts and which are arranged uniformly along and around two substantially parallel and horizontal shafts. The shafts are driven by a motor which can drive the shafts in opposite directions. Furthermore, the shafts have a mutual spacing which is somewhat greater than twice the spacing between the radial outer point of a knife and the axis of rotation. The drive apparatuses are provided between the motor and the shafts.

The material is fed to the knives through a shaft arranged above the knives. These knives interact with knives fixed in a stationary manner between the shafts on part of the frame of the apparatus for material comminution when the shafts rotate in opposite directions. In other words the cutting edge of the blades is moved toward one another on the top side of the stationary knives.

For this purpose, as previously known from the earlier prior art, the mutual spacing between the two shafts is a fixed spacing.

As known in the art, drive devices comprise, likewise in a previously known way, a suitable gearbox for each of the two shafts, a hydraulic motor with adjustable rotational speed for driving each shaft, an adjustable pump for supplying each hydraulic motor and gearbox, by means of which the motor drives the pumps. The pumps are able to reverse the flow through the hydraulic motors in order to rotate each shaft individually forward and backward in accordance with a predetermined sequence.

As disclosed in EP 0 521 081 B1, it is possible to gather that it is important: for each knife to comprise two substantially U-shaped blades arranged one behind the other; for the radially outer and front parts of the two blades, seen in the direction of rotation of the cutting movement of the knives, to be constructed as substantially tangentially oriented wedges; for the spacing between the axis of rotation and the wedge of the front blade to be shorter than the spacing between the axis of rotation and the wedge of the following blade; and for the radially outer contour of the following blade to correspond substantially to a segment of a spiral line around the axis of rotation.

For this purpose, in a functional combination, the features of the comminution machine corresponding to EP 0 928 222 B1, which is of the generic type, can be supplemented in order to obtain a functioning unit.

Accordingly, the stationary knives are formed by a previously known cutting table, which is arranged at the bottom of a hopper having at least one set of fixed, parallel lower knives, which are separated from one another by openings through the table.

Furthermore, at least one rotatable shaft of a drive unit is provided in known manner, wherein the shaft is arranged above the cutting table in a direction which extends at right angles to the lower knives.

Finally, as is known, there are a number of disk-like upper knives, which are fixed to the shaft. Each knife is provided with a number of teeth and extends partially downward into each of their openings in the table. Each opening is wider than the associated upper knife which, in addition, is arranged close to one of the lower knives in the associated opening.

Accordingly, it is important that the lower knife extends in a direction which intersects the axis of the shaft or a region around the latter, wherein a cutting table whose plane already extends underneath the shaft is known as disclosed in DK 169,378.

In this case, on each side of the shaft there is arranged a set of a plurality of knives, whose arrangement in relation to one another forms a V or an inverted V, wherein the respective cutting edges can be designed to be cured or wavy.

As disclosed in EP 0 928 222 B1, the cutting table is divided into knives, in which the plane of the cutting table intersects the axis of the shaft, the intention is for the material to be comminuted with an advantageous cutting angle of about 90°.

A comminution machine for materials, such as organic waste, bulky waste or the like, assembled in this way in accordance with the prior art described above, in spite of a tried and tested function, still exhibits disadvantages such as:

- the stability of the comminution tools fitted to the shaft is endangered;
- the effectiveness of the comminution process is limited by the stationary knives;
- the throughput cannot be increased, because of the action of the shape of the comminution tools on the shaft, in interplay with the stationary knives, forces material away; and
- the power consumption of the machine is relatively high.

SUMMARY OF THE INVENTION

The invention is directed to a grinding machine and a method of grinding for all kinds of material, for example waste, such as domestic waste and bulky waste or wood. Such waste includes refrigerators, tires, furniture, carpets, mattresses, tree stumps, demolition timber or similar materials, which comprises. In an embodiment, the machine comprises:

- a receiving element for material, provided in a housing,
- at least one shaft, on which grinding tools are arranged,
- rigid cutting tools which are fitted in the housing, whose cutting edges extend to, but do not intersect the axis of the shaft or a region around the axis, against which rigid cuffing tools the grinding tools of the shaft grind the material.

Thus, in interplay between the grinding tools acting in opposite directions of rotation with the rigid cutting tools, the waste is always taken in a differentiated manner, is conveyed and, fixed against the rigid cutting tools, while being grinded with specifically low forces.

On one hand, the grinding machine must be configured for production, operation, maintenance and repair in subassemblies suited for this purpose and, on the other hand, must be capable of control to the conditions of the grinding process.

As a result of the invention, the stability of the grinding tools of the shaft is to be increased, the level of grinding is to be increased by means of constructional changes in the rigid cutting tools, the throughput of the machine is to be increased, the power consumption of the machine is to be reduced, the ability to grind in particular ductile, non-brittle-fracture materials, such as plastic and plastic film, is to be promoted and the material present in the receiving area and to be grinded directly is to be fed completely to the available cutting geometries.

In an embodiment,

The grinding tools, seen respectively in a direction of rotation of the shaft and in their cross section, have at least two cutting regions, of which at least an inner cutting region is able to take and comminute more material to be comminuted and has a relatively short lever arm for this purpose, and also at least one outer cutting region is able to take and comminute less material to be comminuted and has a relatively long lever arm for this purpose. The cutting contours of both cutting regions form a circular arc about the axis of the shaft in the direction of the axis of the shaft.

Further, the rigid cutting tools have a number of teeth arranged in a manner of a saw and thus two flanks of the teeth at an angle to each other interact with one of the cutting regions.

In each starting effective cutting position, a tip of the grinding tools, forming a first transverse cutter, is oriented toward a tip of a tooth of the rigid cutting tools, forming a second transverse cutter, so as to be offset in parallel and cutting past, as a result of which the cutting forces produced between the cutting regions of the grinding tools and the cutting edges of the rigid cutting tools, an additional breaking edge, also arranged parallel to the axis of the shaft, with a parallel offset notching action on the material is obtained.

Accordingly, the material is subjected to an active and additional grinding process with the aggressive participation of the teeth of the rigid cutting tools.

In a further aspect of the invention, the grinding tools are offset in relation to one another in the axial direction on the shaft or are arranged with a different radial spacing. The teeth on the rigid cutting tools also are arranged accordingly, wherein the rigid cutting tools run as a slab.

Furthermore, the shaft has disks on which the grinding tools are arranged or formed. These grinding tools interact with the teeth, specifically intermeshing between the rigid cutting tools of the slab arranged at intervals.

In order to be able to install and dismantle the shaft in a beneficial way, it has journals on both sides which are detachably joined to the shaft and, if appropriate, form a bearing region. In this case, the joint can be configured such that it is made by means of a flange.

The housing is formed by a double-walled design at the ends and, in between the ends and the housing, a disk is connected to the shaft and a labyrinth seal to seal against the emergence of material is provided which can expediently be formed by the flange.

The cutting contours of the teeth of the rigid cutting tools configured in the manner of a saw can be formed by wearing elements which, for example, can be replaceable.

Thus, the present invention provides for:

increasing the level of grinding, increasing the throughput and reducing the power consumption in order to improve the efficiency of the grinding machine and for the further optimization of the grinding process, use is also made of a controller which obtains its reference variables from at least one gradient of a parameter of the grinding process.

BRIEF DESCRIPTION OF THE DRAWINGS

The invention will be explained in more detail below using an exemplary embodiment. In the drawings.

DESCRIPTION OF THE INVENTION

Figure 1:
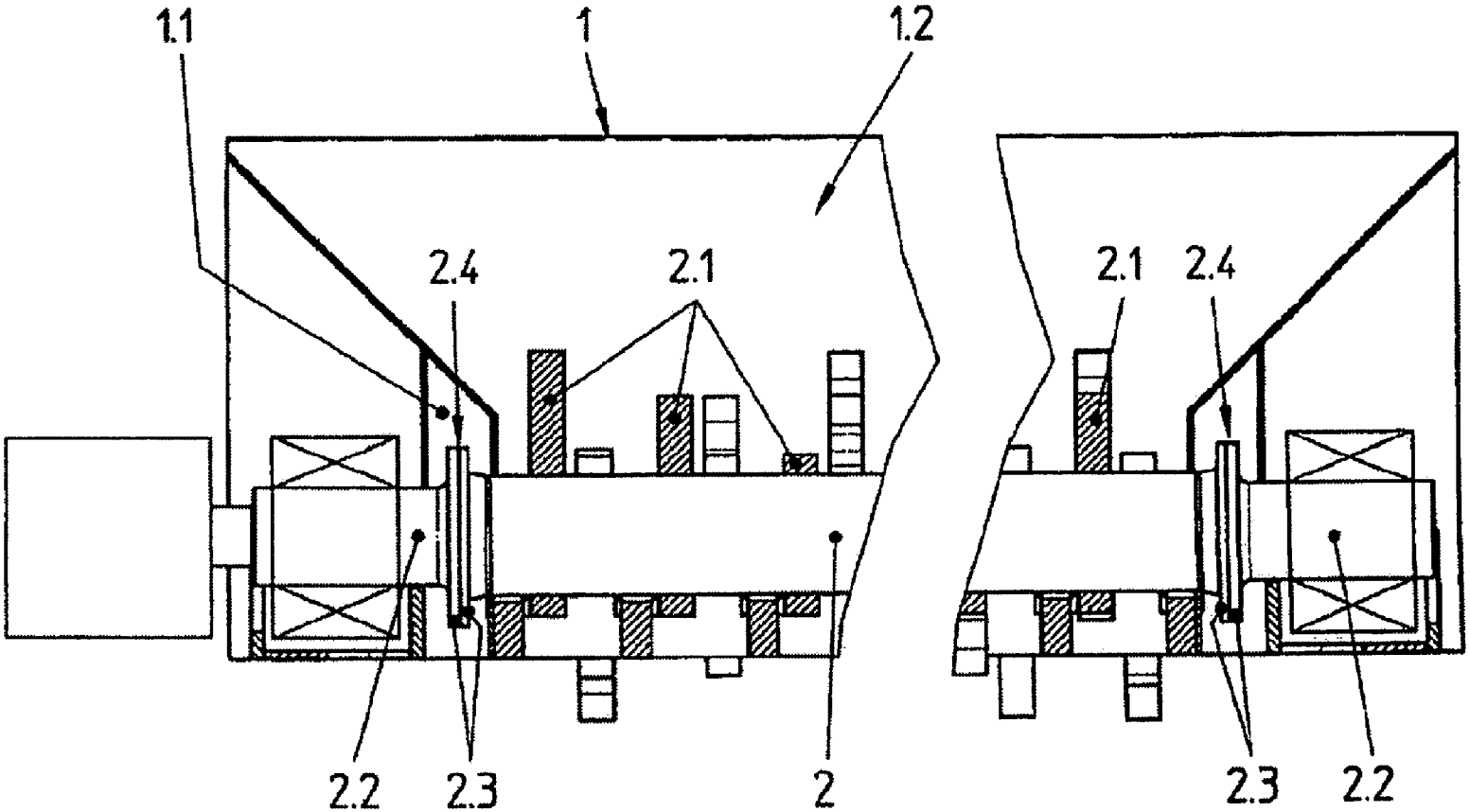
FIG. 1 shows a longitudinally sectioned side view of the grinding machine.
Figure 2:
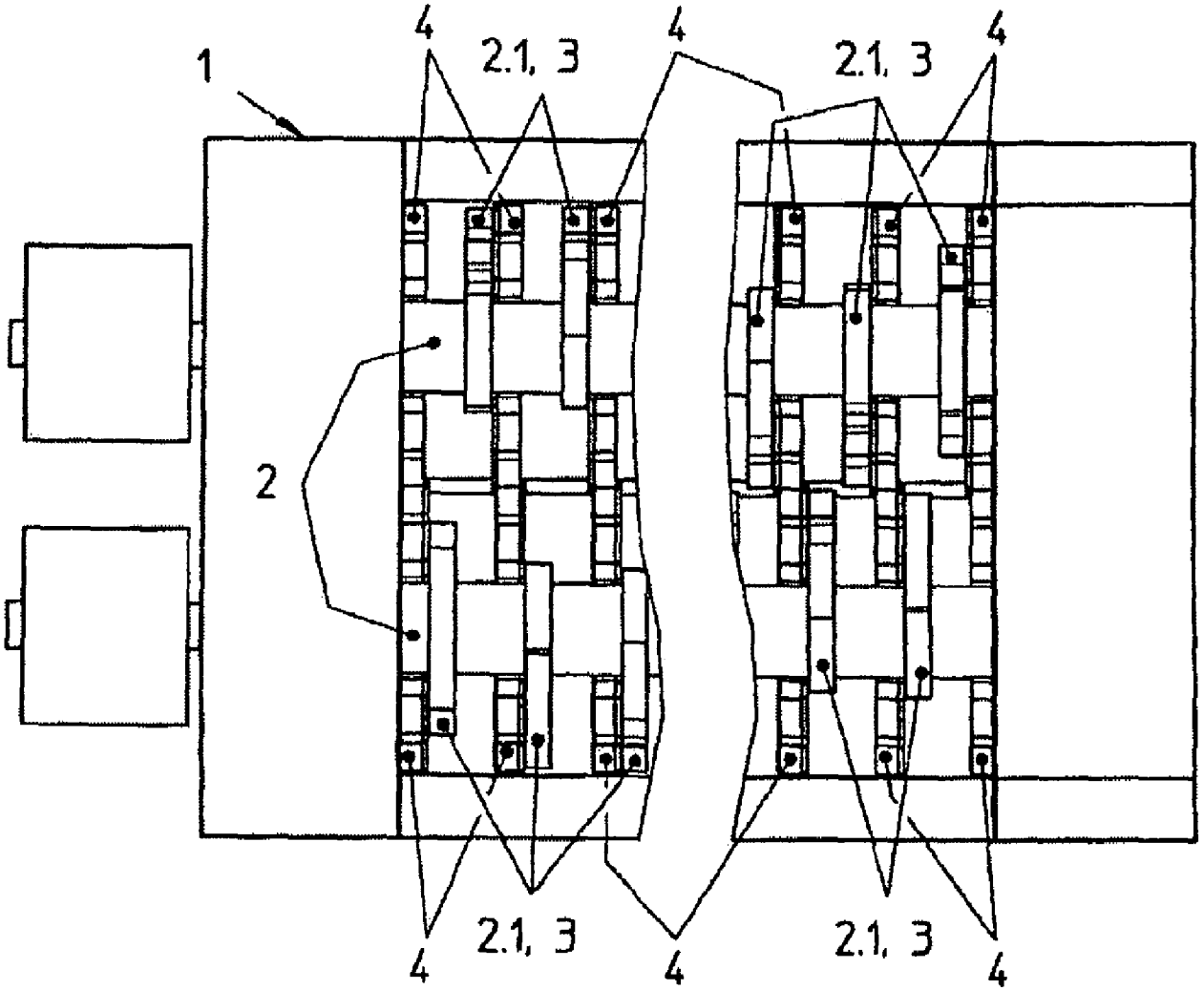
FIG. 2 shows a plan view according to FIG. 1.

A grinding machine according to the present invention for domestic waste, bulky waste or wood, according to FIGS. 1 and 2, comprises a housing 1 having two shafts 2 mounted therein and driven in opposite directions. Turning FIG. 2, arranged on the shafts 2 are disks 2.1 which have grinding tools 3. These grinding tools 3 are lined up in a row at intervals from one another on the shafts 2 such that they operate offset in parallel in interaction with rigid cutting tools 4, which run as a slab in the axial direction of the shafts 2, and grind material 5 put in via a receiving element 1.2 in a cutting manner.

As compared with the known prior art, it is important for the technical requirement on the grinding machine that imaginary extensions of the cutting edges 4.1 (FIGS. 3 to 5) of the rigid cutting tools 4 do not intersect the axis of the shafts 2 or regions around the axis.

As such, in interplay of the grinding tools 3 with the rigid cutting tools 4, the material 5 can be taken in a differentiated manner, conveyed and, fixed against the rigid cutting tools 4, and grinded with specifically low forces. Accordingly, the efficiency of the grinding machine 10 with regard to the grinding process is increased substantially as compared with the conventional shredders.

Figure 3:
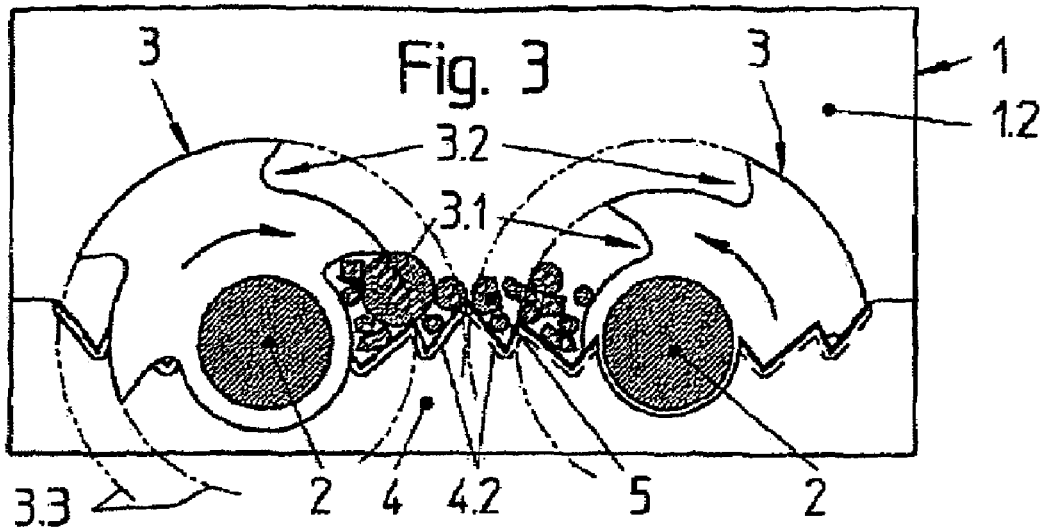
FIG. 3 shows the cross section corresponding to FIGS. 1 and 2 in a simplified representation of the features important to the invention of the phases of the active principle of the invention between the grinding tools and the rigid cutting tools in an operating phase with the material put in and not yet ground.
Figure 4:
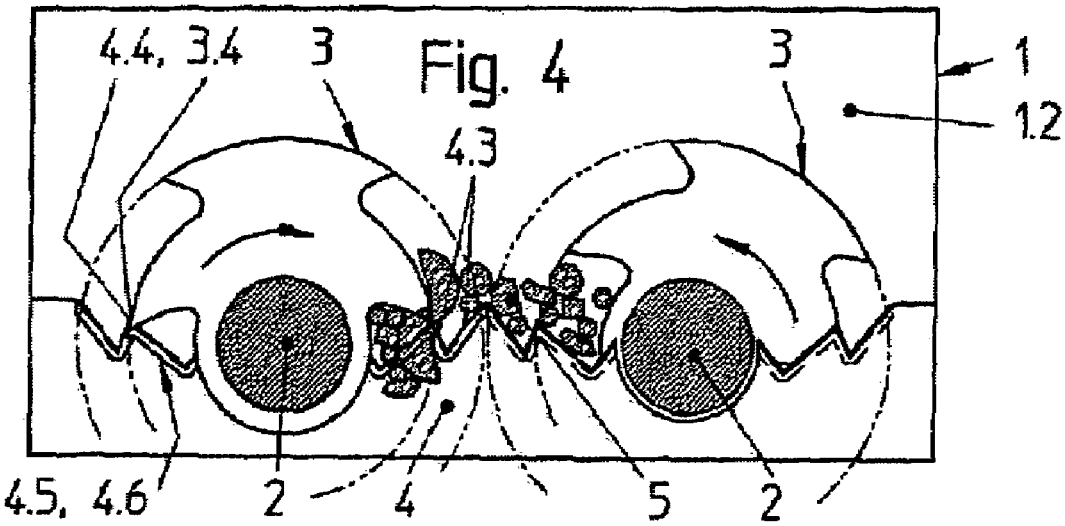
FIG. 4 shows the cross section analogous to FIG. 3 in a sequential operating phase of the grinding process.
Figure 5:
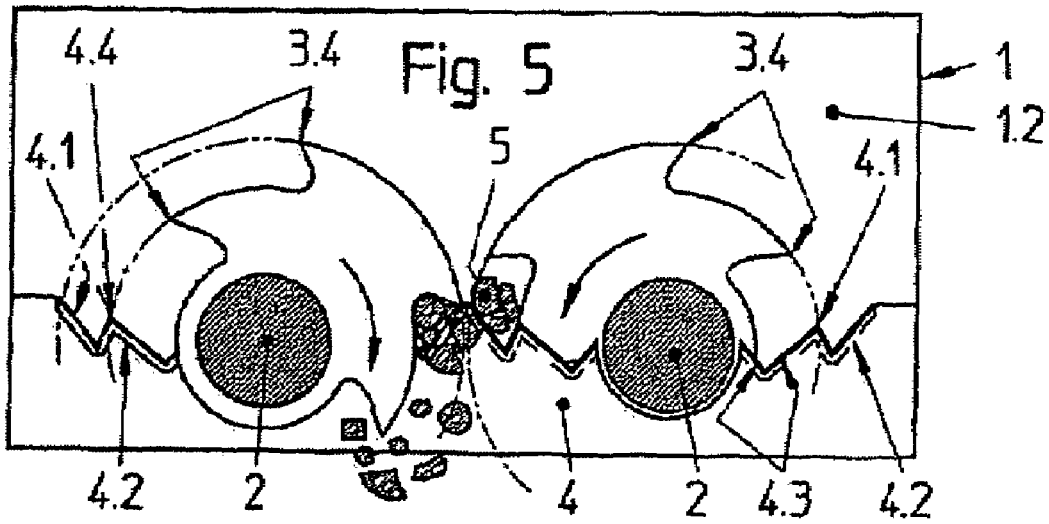
FIG. 5 shows the cross section analogous to FIGS. 3 and 4 in another sequential operating phase of the grinding process.

In accordance with FIGS. 3 to 5, the plurality of grinding tools 3, in each case seen in a direction of rotation of the shaft 2 and in their cross section, have two cutting regions 3.1, 3.2 which are configured such that the stability of the plurality of grinding tools 3 is not endangered.

The inner cutting region 3.1 takes more material 5 to be grinded and acts with a relatively short lever arm, and the outer cutting region 3.2 takes less material 5 to be grinded and acts with a relatively long lever arm. In this case, the contours 3.3 of the cutting regions 3.1, 3.2 in each case describe a concentric circular arc about the shaft 2 in the direction of the axes of the shafts 2.

With this design implementation, the preconditions are given for using the available forces more effectively than hitherto for the grinding process of the respective material and in a more differentiated manner.

The plurality of rigid cutting tools 4 have a plurality of teeth 4.2 arranged in the manner of a saw. Thus, two flanks 4.3 of the teeth 4.2 at an angle to each other interact with at least one of the cutting regions 3.1, 3.2 in such a way that the respective material 5 is always clamped in and is notched and cut comprehensively by the available edges of the cutters.

As shown in FIG. 3, a tip of each grinding tool 3 forms a first transverse cutter 3.4 which orients toward a tip of a tooth 4.2 of the rigid cutting tools 4, forming a respective second transverse cutter 4.4, so as to be offset in parallel and cutting past. As a result, besides the cutting forces produced and acting between the cutting regions 3.1 and 3.2 of the grinding tools 3 and the cutting edges 4.1 of the rigid cutting tools 4, an additional breaking edge, also arranged parallel to the axis of the shaft 2, with a notching action offset parallel to the respective piece of material 5 is obtained.

As such, the present invention subjects the material 5 to an active and additional grinding process with the aggressive participation of the teeth 4.2 of the rigid cutting tools 4.

Conclusively in relation to the increased requirements placed and to the object set in accordance with the invention, this grinding machine is better suited to the types of material 5 previously discussed such that:

the stability of the grinding tools 3 is increased, the level of grinding and the throughput are increased, the power consumption is reduced and, finally, the grinding process of a "shredder" is supported.

During use, the actions of the grinding machine according to the invention can be gathered from FIGS. 3 to 5 in three phases illustrated.

Referring to FIG. 3, the illustration shows schematically how the material 5 can be taken in different volumes by cutting regions 3.1 and 3.2 acting with different lever arms and can be distributed to the rigid cutting tools 4 between the two flanks 4.3 in such a way that the grinding is prepared optimally.

Turning to FIG. 4, by the actions of the cutting regions 3.1, 3.2 against the cutting-edges 4.1, the material 5 clamped in the flanks 4.3 is cut and, secondly, is subjected to the corresponding actions of the first transverse cutters 3.4 with the second transverse cutters 4.4 and the additional breaking edge effect.

FIG. 5 shows in particular the phase in which the outer cutting regions 3.2 having the long lever arm and the corresponding lesser amount of material 5 act against the rigid cutting tools 4.

While maintaining the active principle according to the invention and assisting the matter further, according to FIGS. 1 and 2, the grinding tools 3 are arranged offset radially from one another in the actual direction on the shafts 2. (Not shown) In another embodiment, the grinding tools 3 are arranged in a different angular position on the shafts 2, that is to say axially in the cutting profile, for example running conically. (Not Shown) Accordingly, the teeth 4.2 of the rigid cutting tools 4 running axially as a slab also have to be arranged as such.

The technologically beneficial implementation for the production, the operation, the maintenance and repair of the grinding machine according to the invention is achieved with the features further illustrated in FIG. 1. For this purpose, the shafts 2 have journals 2.2 forming a bearing region at the ends wherein the journals 2.2 are detachably joined to the shaft 18. The joint between the journals 2.2 and the shafts 2 is made by means of flanges 2.3.

In operation, in order to assist optimal grinding and reliability of the grinding machine, it is important that no material 5 penetrates through components to be sealed off from one another. Therefore, the housing 1 according to FIG. 1 is designed with a double wall 1.1 at the ends, in which the journals 2.2 or ends of the shaft 2 have a disk seal 2.4, which forms a sealing labyrinth with the double wall 1.1. In an embodiment, the disk seal 2.4 is formed by the flanges 2.3.

In order to protect the rigid cutting tools 4 against wear, it is beneficial, as indicated in FIGS. 3 to 5, to equip the cutting contours 4.5 of the rigid cutting tools 4 with wearing elements 4.6.

In all of the features claimed, a machine grinding designed according to the invention is optimally able to meet the increased requirements on the grinding of material of the types described by including a means for controlling the grinding machine, wherein a gradient of a parameter of the grinding machine is registered and used as a reference variable for the control of the grinding machine.

LIST OF DESIGNATIONS

1=Housing
1.1=Double wall
1.2=Receiving element for material
2=Shaft
2.1=Disk
2.2=Journal
2.3=Flange
2.4=Disk seal
3=Comminution tool
3.1=Inner cutting region, short lever arm
3.2=Outer cutting region, long lever arm
3.3=Contour
3.4=First transverse cutter
4=Rigid cutting tool
4.1=Cutting edge
4.2=Tooth
4.3=Tooth flank
4.4=Second transverse cutter
4.5=Cutting contour
4.6=Wearing element
5=Material

The invention claimed is:

1. A grinding machine, comprising:

a housing having a receiving element which receives material;

at least one shaft which is axially mounted in the housing;

a plurality of grinding tools connected to the at least one shaft in an angular position in an axial direction of the least one shaft, each grinding tool having a first transverse cutter, an inner cutting region and an outer cutting region such that the inner cutting region is configured to receive from the receiving element a first amount of material and the outer cutting region is configured to receive from the receiving element a second amount of material, the inner cutting region having a shorter lever arm than the outer cutting region; and a plurality of rigid cutting tools arranged within the housing in a fixed position on opposing sides of the least one shaft, each rigid cutting tool having teeth arranged in a saw-like manner providing flanks at an angle to each other, and a second transverse cutter wherein the at least one shaft rotates the plurality of grinding tools such that the inner cutting region of a grinding tool grinds the amount of material against one tooth of the corresponding rigid cutting tool, while the outer cutting region of said grinding tool grinds the other amount of material against one further tooth of the rigid cutting tool and the first transverse cutter orientates in an offset parallel position toward the second transverse cutter to grind material between the first transverse cutter and the second transverse cutter.

2. The grinding machine of claim 1, wherein the plurality of grinding tools are offset in relation to one another in the angular position in an axial direction of the at least one shaft.

3. The grinding machine of claim 2, wherein the plurality of grinding tools are arranged in a radial spacing with respect to the axis of the at least one shaft.

4. The grinding machine of claim 3, wherein the teeth of the rigid cutting tools extend offset parallel in the axial direction such that the first transverse cutter is oriented toward the second transverse cutter to grind the material in an offset parallel action.

5. The grinding machine of claim 1, wherein the at least one shaft has disks on which the grinding tools are arranged; wherein the grinding tools intermesh between the rigid cutting tools and act against the rigid cutting tools in a cutting manner.

6. The grinding machine of claim 1, characterized in that wherein the at least one shaft has journals which are detachably joined to the at least one shaft.

7. The grinding machine of claim 6, wherein the journals form a bearing region.

8. The grinding machine of claim 7, further comprising flanges which form a joint between the journals and the at least one shaft.

9. The grinding machine of claim 8, wherein the housing is formed with a double wall at ends of the housing and, in the interspace therein, a disk seal connected to the at least one shaft is provided to form a seal.

10. The grinding machine of claim 9, wherein the seal is formed by the flanges.

11. The grinding machine of claim 1, wherein the rigid cutting tools are reinforced by wearing elements.

12. The grinding machine of claim 1, further comprising a means for controlling the grinding machine wherein a gradient of a parameter of the grinding process or grinding machine is registered and used as a reference variable for control of the grinding machine.

13. The grinding machine according to claim 1, wherein the plurality of rigid cutting tools are fixed within the housing in a position separate from the axis of the at least one shaft.

14. The grinding machine of claim 1, wherein the inner cutting region and the outer cutting region include contours which form a circular arc about the axis of the at least one shaft in the direction of the axis of the least one shaft.

15. The grinding machine of claim 1, wherein the plurality of grinding tools are circumferentially connected to the at least one shaft.

16. A grinding machine, comprising:

a housing having a receiving element which receives material;

at least one shaft which is axially mounted in the housing;

a plurality of grinding tools connected to the at least one shaft in an angular position in an axial direction of the least one shaft, each grinding tool having a first transverse cutter, an inner cutting region and an outer cutting region such that the inner cutting region is configured to receive from the receiving element a first amount of material and the outer cutting region is configured to receive from the receiving element a second amount of material, the second amount of material received by the outer cutting region being less than the first amount of material received by the inner cutting region, the inner cutting region having a shorter lever arm than the outer cutting region; and a plurality of rigid cutting tools arranged within the housing in a fixed position on opposing sides of the least one shaft, each rigid cutting tool having teeth and a second transverse cutter wherein the at least one shaft rotates the plurality of grinding tools such that the inner cutting region grinds the amount of material against the-teeth of the rigid cutting tools, the outer cutting region grinds the other amount of material against the teeth of the rigid cutting tools and the first transverse cutter orientates in an offset parallel position toward the second transverse cutter to grind material between the first transverse cutter and the second transverse cutter.

17. The grinding machine of claim 1 wherein imaginary extensions of the cutting edges of the rigid cutting tools do not intersect the axis of the at least one shaft or regions around this axis.

* * * * *